US005898352A

United States Patent [19]

McEachern et al.

[11] Patent Number: 5,898,352

[45] Date of Patent: Apr. 27, 1999

[54] MAGNETIC CYLINDER WITH THIN FORAMINATE LAYER BETWEEN CYLINDER CORE AND MAGNETIC ELEMENTS

[75] Inventors: David A. McEachern, St. Paul; Robert A. Heitman, St. Paul Park, both of Minn.

[73] Assignee: T. D. Wright, Inc., St. Paul, Minn.

[21] Appl. No.: 08/976,764

[22] Filed: Nov. 24, 1997

[51] Int. Cl.[6] ..... H01F 7/02

[52] U.S. Cl. ..... 335/306; 335/302

[58] Field of Search ..... 156/293; 335/302–306, 335/285, 288, 295; 209/219, 212, 213, 214, 636; 264/272.11

[56] References Cited

U.S. PATENT DOCUMENTS

| | | | |
|---|---|---|---|
| 3,742,852 | 7/1973 | Leffler | 101/378 |
| 4,823,102 | 4/1989 | Cherian | 335/306 |
| 4,834,870 | 5/1989 | Osterberg | 209/38 |
| 5,207,330 | 5/1993 | Siesco, Jr. | 209/219 |
| 5,236,091 | 8/1993 | Kauppila | 209/212 |

*Primary Examiner*—Michael L. Gellner
*Assistant Examiner*—Richard Kyung Lee
*Attorney, Agent, or Firm*—Jacobson and Johnson

[57] ABSTRACT

In a magnetic cylinder for holding printing plates and the like in which magnetic elements are located and held in place in recesses formed on the outer surface of the cylinder, a thin substantially non-magnetic foraminate layer is located at the bottom of the recesses and the magnetic elements rest against the foraminate layer.

6 Claims, 1 Drawing Sheet

MAGNETIC CYLINDER WITH THIN FORAMINATE LAYER BETWEEN CYLINDER CORE AND MAGNETIC ELEMENTS

FIELD OF THE INVENTION

This invention is in the field of curved magnetic latches or holding devices specifically in the form of a magnetic drum or cylinder (or a section of a magnetic cylinder) for use in holding printing plates or die-cutting plates or the like. More particularly, the invention is directed toward magnetic cylinders which are formed by placing magnetic elements into pockets or recesses formed on the outer surface of the cylinder.

DESCRIPTION OF THE PRIOR ART

U.S. Pat. No. 5,627,505 by Iwaszek describes a magnetic cylinder in which a stack of elongated magnetic elements comprising a number of elongated hard ceramic permanent bar magnets with intermediate pole pieces in close intimate contact with one another are located in axial extending recesses or slots, sometimes referred to as pockets, formed on the surface of a cylindrical drum to provide the magnetic field for the magnetic cylinder. Similarly, other prior art devices use magnetic elements which are placed in circumferential extending or spaced recesses or slots formed on the outer surface of the cylinder to provide the magnetic field. An adhesive may be used to help hold the magnetic elements securely in place in the pockets. It has been found that it is not uncommon that when the magnetic elements are placed into the recesses with adhesive, air pockets may form in the adhesive and have no way to escape. As a result even though it may appear that the magnetic elements are seated properly, in time the air pockets collapse so that the magnetic elements may be skewed. Even though this may seem to be a very small variance, it has created problems when the cylinder is in use.

Also, in order to minimize magnetic field leakage, the inner core of these prior cylinders was made out of a material which is substantially nonmagnetic, yet strong enough to withstand the forces encountered when the cylinder is in use. Therefore, in prior devices the core often is made, for example, of a nonmagnetic 300 Series stainless steel which may be quite costly as compared to mild or tool steel.

SUMMARY OF THE INVENTION

A generally rigid, substantially incompressible, thin, foraminate, substantially nonmagnetic layer is placed at the bottom of the pockets or recesses or grooves in which the magnetic elements are placed to allow air which otherwise might be entrapped in adhesive to escape when the magnetic elements are placed into the pockets. The foraminate layer rests against the cylinder core and the magnetic elements rest in the pockets or grooves against the foraminate layer. As a further feature, the foraminate layer provides an air gap between the magnetic elements and the core of the cylinder thereby minimizing any significant loss of magnetic field or reduction of the magnetic force provided by the magnetic elements at the outer surface of the cylinder. As a result the cylinder core can be of less costly material such as mild or tool steel, thereby significantly reducing the manufacturing cost.

BRIEF DESCRIPTION OF THE DRAWINGS

The single FIGURE.

DESCRIPTION OF THE PREFERRED EMBODIMENTS

Figure 1:
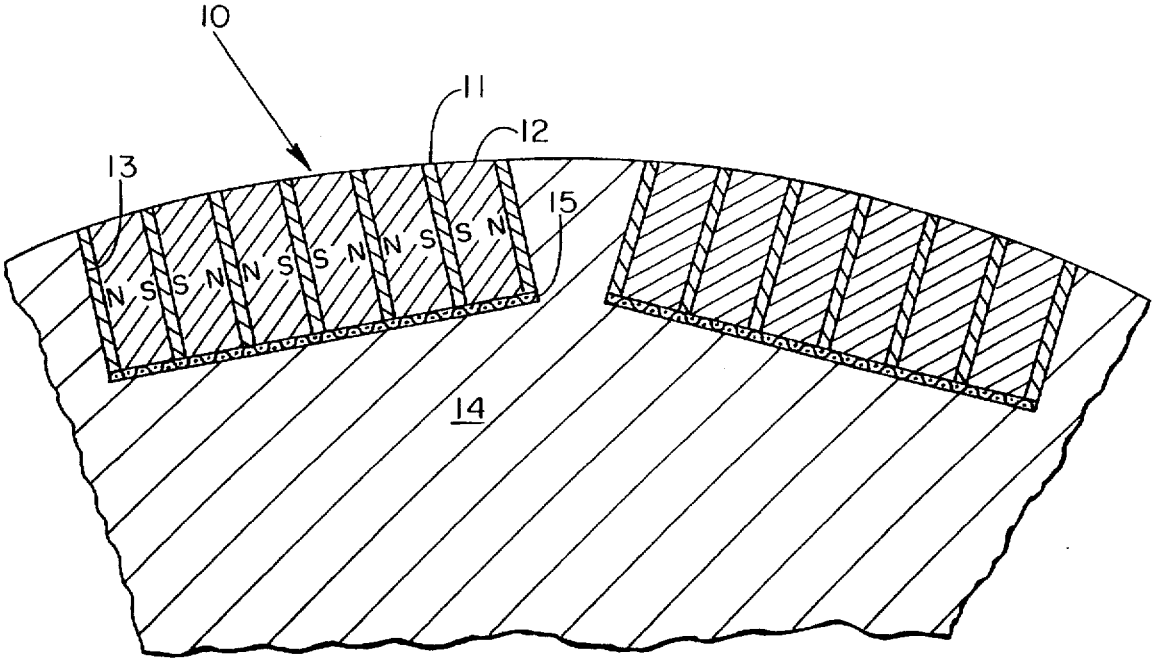
FIG. 1, is a section view of a portion of a magnetic plate cylinder constructed according to the teachings of the instant invention.

The aforementioned Iwaszek U.S. Pat. No. 5,627,505 describes in some detail the construction of a printing plate magnetic cylinder in which a magnetic element is formed by a stack of elongated bar magnets 12 separated from one another by pole pieces 11 which are in intimate close contact with the adjacent magnets. Magnets 12 are polarized so that successive magnets in a circumferential direction have similar poles facing one another so that the intermediate pole piece 11 takes on that polarity. For the purposes of the description portion, the aforementioned '505 patent is incorporated herein by reference. The magnetic element stack 10 is placed in a pocket or recess or groove 13 which extends across the outer periphery of the magnetic cylinder in an axial direction. Conventionally, the core 14 of the cylinder may have a bore at its center, not shown, to accommodate a driving shaft on which the cylinder is mounted or may be solid and have a shaft, not shown, extending out one or both ends for mounting to a rotating driving source. In the past, as described in the aforementioned '505 patent, the magnetic elements rest in the pockets or recesses 13 with the inner edges against the core 14. To prevent undue leakage of the magnetic field, which would otherwise reduce the strength of the magnetic field at the outer surface, the core was generally made of a material which has the necessary physical strength but also a low magnetic permeability. An example of this would be 300 Series stainless steel. This could significantly increase the manufacturing cost of the cylinder. In addition, as mentioned in the '505 patent, a suitable adhesive, not shown, is generally used to help hold the stack of pole pieces and magnets in place in the recesses 13. A suitable adhesive for this purpose is an epoxy resin such as a commercial product known as Fuller's Resiweld FE-7004. Experience has shown that sometimes air pockets form in the adhesive when the magnetic elements 10 are inserted into recesses 13. The stacks appear to be firmly and properly seated in the recesses 13 but later the air pockets may collapse causing what might seem to be a trivial shift in the seating of the magnetic stack but what actually can cause significant problems when the magnetic cylinder is in use. The present invention utilizes a substantially incompressible, rigid foraminate or perforated layer 15 at the bottom of the recess or pocket 13 which the magnetic elements rest against when seated in the recesses 13.

The perforations in the foraminate layer provide spaces for air to escape into thereby eliminating the forming of air pockets in the adhesive. Also, the foraminate layer provides a gap between the magnetic elements and the core thereby substantially reducing magnetic field leakage at the interior of the cylinder which otherwise might reduce the magnetic field or holding force at the outer surface of the cylinder. Because of the gap provided by the foraminate layer, the core can be made of a less expensive material, as explained hereinabove.

In practice after the pockets or recesses 13 are formed in the cylinder the foraminate layer 15 and often a suitable adhesive, not shown, are placed in the recesses 13 and the stacks of magnetic elements 10 consisting of pole pieces 11 and magnets 12 are inserted under pressure radially into the recesses 13 to force the inner edge of the stack of magnetic elements against the foraminate layer 15. In the process, air which might otherwise get entrapped in the adhesive can escape into the perforations in foraminate layer 15. As mentioned in the '505 patent, end cap rings, not shown, may be used to help hold the magnetic elements in place.

Typically, for example and with no limitation intended, the foraminate layer 15 may be a nonmagnetic steel wire mesh of a coarseness of 0.028 inch diameter and a 16×16 grid. A popular size cylinder is a 16" cylinder and typically, for exemplary purposes only, may have pockets or recesses about ¾" wide and about ¼" deep. As mentioned earlier, the screen or foraminate layer 15 and adhesive are inserted in the recess 13 and the stack of pole pieces and magnets is inserted under pressure into the recess 13. This may cause some excessive adhesive to ooze out along the edges which would have to be removed. Ordinarily the cylinder then is allowed to set under pressure until the adhesive hardens or sets.

While there does not appear to be any specific most desirable dimension for the thickness of the foraminate layer, it should be thin enough so that the suitably dimensioned magnetic elements can be inserted into the recesses to produce an acceptable magnetic field yet thick enough to provide adequate space for any otherwise entrapped air to escape and a sufficient air gap to keep magnetic field loss through the core to a minimum. It is possible that some formula may be derived to determine a preferred range of the ratio of foraminate layer thickness to magnetic element size for a given cylinder, depending in part on the type of magnetic elements, cylinder size and other factors.

We claim:

1. For a magnetic cylinder comprising a cylindrical drum having magnetic elements in recesses on the outer surface of the drum, the improvement comprising:

a thin foraminate layer made of a rigid incompressible non-magnetic material at the bottom of the recesses, the magnetic elements resting in the pockets against the foraminate layer.

2. The invention as described in claim 1 further including adhesive placed in the recesses for holding the magnetic elements in place.

3. For use in the process of making a magnetic cylinder by inserting magnetic elements into recesses formed at the outer surface of the cylinder, the steps of:

a) placing a thin, rigid, incompressible, non-magnetic foraminate layer at the bottom of the recesses;

b) placing the magnetic elements into the recesses so that they rest against the foraminate layer.

4. The process as described in claim 3 further including placing adhesive into the recesses for securing the magnetic elements in place.

5. A magnetic printing plate cylinder comprising:

a) a cylindrical drum having recesses on its outer surface;

b) a thin, rigid, substantially non-magnetic foraminate layer at the bottom of each recess; and c) magnetic elements in each of said recesses resting against said foraminate layers.

6. The magnetic printing plate cylinder as described in claim 5 further including adhesive in said recesses for holding said magnetic elements in place.

* * * * *